United States Patent [19]

Koopmans et al.

[11] Patent Number: 4,733,568

[45] Date of Patent: Mar. 29, 1988

[54] BOREHOLE DILATOMETER INTENSIFIER

[76] Inventors: Robert Koopmans, R.R. 2, Acton, Ontario, Canada, L7J 2L8; Robin W. Hughes, 65 Waterford Drive, Weston, Ontario, Canada, M9R 2N7

[21] Appl. No.: 830,354

[22] Filed: Feb. 18, 1986

[30] Foreign Application Priority Data

Sep. 9, 1985 [CA] Canada ..... 490229

[51] Int. Cl.[4] ..... G01N 3/00

[52] U.S. Cl. ..... 73/784

[58] Field of Search ..... 73/784, 151; 417/225, 417/226, 227, 403; 91/275; 166/100

[56] References Cited

U.S. PATENT DOCUMENTS

| | | | |
|---|---|---|---|
| 2,381,929 | 8/1945 | Schlumberger | 166/100 |
| 2,539,292 | 1/1951 | Anderson | 417/225 |
| 2,777,425 | 1/1957 | Adams et al. | 91/275 |
| 2,959,226 | 11/1960 | Blood | 166/100 |
| 3,610,035 | 10/1971 | Handy | 73/784 |
| 3,858,441 | 1/1975 | Comeau | 73/784 |
| 3,927,652 | 12/1975 | O'Neill | 123/457 |
| 4,196,619 | 4/1980 | Collins | 73/155 |
| 4,237,723 | 12/1980 | Kent | 73/49.6 |
| 4,343,595 | 8/1982 | Wells et al. | 417/225 |
| 4,557,147 | 12/1985 | Rohde et al. | 73/784 |
| 4,594,899 | 6/1986 | Henke et al. | 73/784 |

FOREIGN PATENT DOCUMENTS

| | | | |
|---|---|---|---|
| 221304 | 4/1969 | U.S.S.R. | 73/784 |

*Primary Examiner*—Michael J. Tokar
*Assistant Examiner*—Robert R. Raevis
*Attorney, Agent, or Firm*—Ridout & Maybee

[57] ABSTRACT

A highly portable pressure intensifier for use with a borehole dilatometer head having an expandable body defining an internal cavity to measure deformation properties of in-situ rock masses. The housing of the intensifier comprises two axially aligned interconnecting cylinders, one of which is of substantially larger diameter. The larger cylinder has a reciprocating piston mounted therein, the piston having a plunger portion which extends axially into the smaller cylinder. The smaller cylinder is connected to the cavity of the dilatometer head by means of high pressure tubing. The larger cylinder is filled ahead of the piston with a first working liquid. The second cylinder, the dilatometer head cavity and the interconnecting tubing are filled with a second working liquid. Increasing the pressure of the first working liquid displaces the plunger portion into the smaller cylinder, substantially increasing the pressure of the second working liquid, which latter increase causes the dilatometer head to expand so as to deform the rock of the borehole in which it is placed. A pressure transducer and a linear variable differential transformer are provided for deriving signals representing changes in pressure and volume respectively.

6 Claims, 3 Drawing Figures

BOREHOLE DILATOMETER INTENSIFIER

Field of the Invention

This invention relates to a pressure intensifier for use with a borehole dilatometer head having an expandable body. Such a device may be employed, for example, in systems for measuring the in-situ deformation of materials at various depths in a borehole.

BACKGROUND OF THE INVENTION

Known systems of this general type comprise a dilatometer head having an expandable body defining an internal cavity, the dilatometer head being adapted to be lowered into a borehole formed for this purpose in materials which may be either natural (for example rocks, soil) or artificial (for example concrete, etc.) in conjunction with hydraulic pressure intensifying means for applying a radial force to the borehole wall through the agency of the expandable dilatometer head, and means for measuring and recording the resultant deformation as a function of the increased volume of the dilatometer head and the applied hydraulic pressure.

Typical pressure intensifiers for pressurizing the dilatometer head are manually-operated, and do not provide integrated pressure and volume measuring means capable of electrical communication with continuous storage or plotting devices. Their use is labour intensive, time consuming and subject to human error. Additionally, because of the rugged in-field use conditions and the high operating pressures normally encountered, it is a requirement that pressure intensifiers for this type of application be of strong, rigid construction. As a consequence, known forms of pressure intensifiers are generally large, heavy and cumbersome, particularly for in-field operations. Leakage has also been a common problem with known designs of intensifiers.

It is an object of the present invention to provide an improved pressure intensifier in which the above-mentioned limitations are overcome. This is achieved by providing a pressure intensifier which is highly portable while at the same time being of strong, rigid construction, and which is capable, in the preferred embodiment described, of producing pressures up to 124 MPa without significant leakage. Moreover, the intensifier of the invention may be used with a wide variety of hand operated or electrically operated hydraulic pumps, the latter of which can be connected to a servo-control unit for remote operation. Additionally, volume and pressure measuring means integrated into the intensifier allow for the continuous storage, plotting or printing of output data and for the simultaneous or subsequent processing of this data by appropriately programmed computer means. Thus, the pressure intensifier of the invention is particularly suited for integration into an automated, computerized dilatometer system for calculating the deformation modulus of rock or similar materials.

SUMMARY OF THE INVENTION

According to the present invention, there is provided a pressure intensifier for use with a borehole dilatometer head having an expandable body portion defining an internal cavity. The intensifier comprises a housing having positioned therein first and second axially aligned inter-connecting cylinders, with the first cylinder being of larger diameter than the second cylinder. Connecting means are provided for establishing fluid communication between the second cylinder and the aforesaid internal cavity of the dilatometer head. A piston, having a head portion and a rearwardly directed plunger portion, is mounted for linear reciprocation of the head portion within the first cylinder so as to define a first chamber of variable volume ahead of the head portion. The plunger portion of the piston is mounted for simultaneous linear reciprocation within the second cylinder so as to define, together with the aforesaid internal cavity of the dilatometer head and the aforesaid connecting means, a second chamber of variable volume behind the plunger portion. Means are provided for introducing a first substantially non- compressible working liquid into the first chamber and for introducing a second substantially non-compressible working liquid into the second chamber. Pressurizing the first working liquid within the first chamber so as to displace the head portion linearly in the rearward direction increases the pressure of the second working liquid within the second chamber. A first transducer for measuring the linear displacement of the head portion of the piston provides an electrical signal indicative thereof and a second transducer for measuring the pressurization of the second working liquid provides a second electrical signal indicative thereof.

BRIEF DESCRIPTION OF THE DRAWINGS

In order that the invention may be readily understood, a single embodiment thereof will now be described, by way of example, with reference to the accompanying drawings in which.

DESCRIPTION OF THE PREFERRED EMBODIMENT

Figure 1:
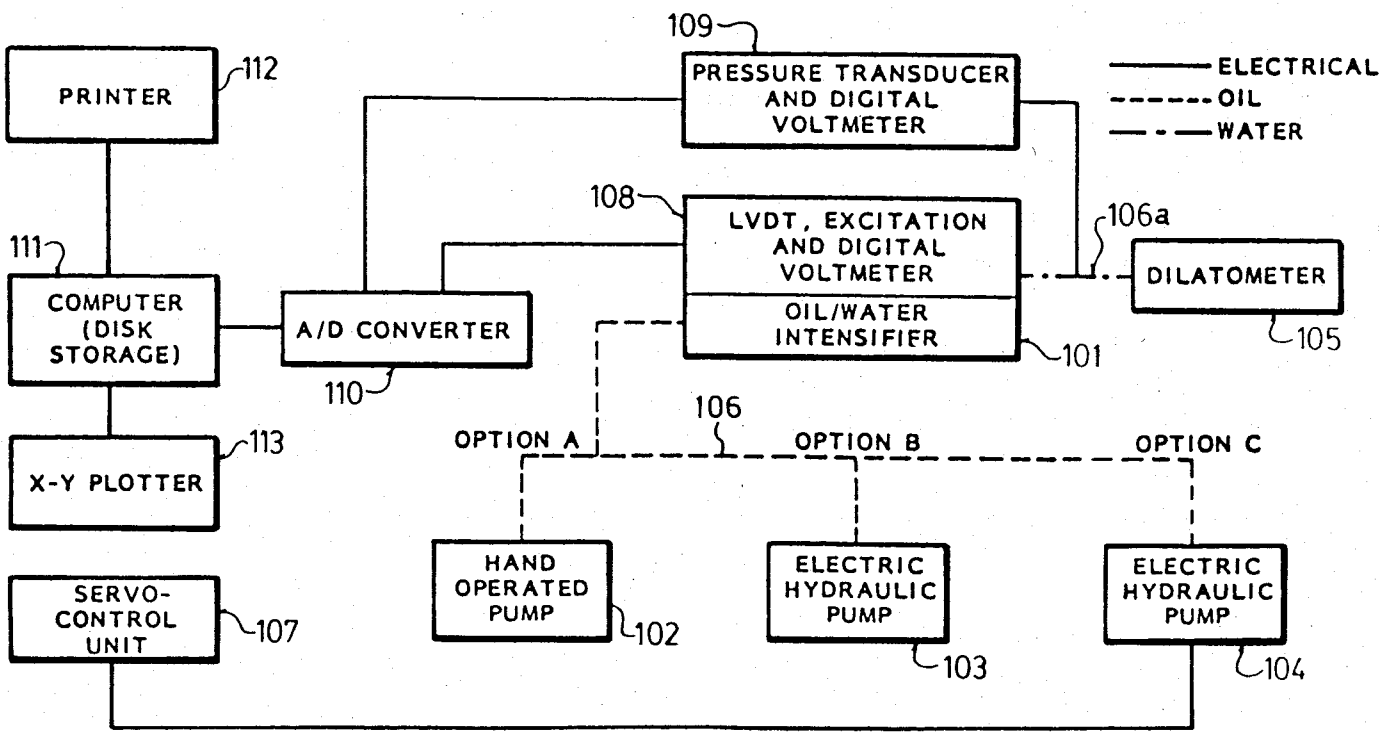
FIG. 1 is a schematic view of an automated computerized dilatometer system into which a pressure intensifier according to the invention is integrated.

While the pressure intensifier of the invention is equipped with transducer means providing a digital readout to allow manual checking of readings during testing, the full benefit of the invention is realized when the intensifier disclosed is integrated into an automated computerized dilatometer system as shown in FIG. 1, which obviates the need for taking manual readings. The system of FIG. 1 highlights a pressure intensifier 101 operated by a hand operated hydraulic pump 102 (Option A), or an electrically-driven hydraulic pump 103, 104 (Options B & C), and a dilatometer head 105. As will be described in more detail below, the pressure intensifier 101 in its preferred form has a 6:1 piston differential ratio between its two cylinders, which cylinders are filled with oil and water, respectively. This arrangement allows lower oil pressures to be administered from the hydraulic pump through standard flexible hydraulic hoses 106, to the pressure intensifier 101, where the pressure of the water is increased six times to provide for water inflation of the dilatometer head through high-pressure thick-walled tubing 106*a*. In Option A, the hand-operated hydraulic pump 102 is used in place of an electrical pump. This option is especially useful when working in underground mines which might contain gases which would make an electrical pump intrinsically unsafe to use. In Option C, a servo-control unit 107 is connected to the electric hydraulic pump 104 so as to allow the operator to control pressure loading and unloading of the dilatometer head 105 from a remote location. A linear variance differential transformer 108, designated "LVDT", is affixed to the housing of the intensifier in a manner to measure the linear movement of the piston during pressure loading and unloading. Such linear movement is directly proportional to volume changes in the water-containing cylinder, which changes are determined by calibration. A pressure transducer 109 is also connected to the water-containing cylinder to measure changes in water pressure.

As previously mentioned, and as seen in FIG. 1, both the LVDT 108 and the pressure transducer 109 have digital readout capabilities. This is accomplished with respect to the LVDT by means of an excitation and digital voltmeter wired thereto and with respect to the pressure transducer by means of a digital voltmeter. Analog signals from both the LVDT and the similarly wired pressure transducer are sent by appropriate electrical connections to an analog/digital converter 110 for conversion to digital signals to be applied to a digital computer 111 the analog/digital converter providing separate communication channels for each of the analog signals. The computer is programmed to store the data on a magnetic disc for later analysis, to print out the data in engineering units by a printer 112 and/or to plot the pressure-volume data points on an x-y plotter 113. Subsequent to the data storage process, another computer program may be run on the data to determine the deformation modulus values from the stored data, according to known formulae as outlined in Hustrulid, W. and Hustrulid, A., "The CSM Cell—A Borehole Device for Determining the Modulus of Rigidity of Rock", 15th Symposium on Rock Mechanics, S. Dak., 1975. The only required change in the known formulae is that the calculations be expressed in terms of pressure/volume instead of pressure/turn, as the intensifier of the present invention moves linearly and eliminates the need to read rotational turns as required by the original CSM (Colorado School of Mines) system. It will be appreciated from general principles and from an analysis of the calculations referred to above, that the rigidity or stiffness of the measuring system (i.e. the pressure intensifier, the dilatometer head and the connecting means connecting these two items) is very important if valid deformation modulus calculations are to be derived from measurements obtained from the system, with higher stiffness values giving more accurate results. An intensifier constructed according to the invention provides for a very rigid structure capable of obtaining highly accurate measurements with resultant accuracy of calculated modulus values.

Figure 2:
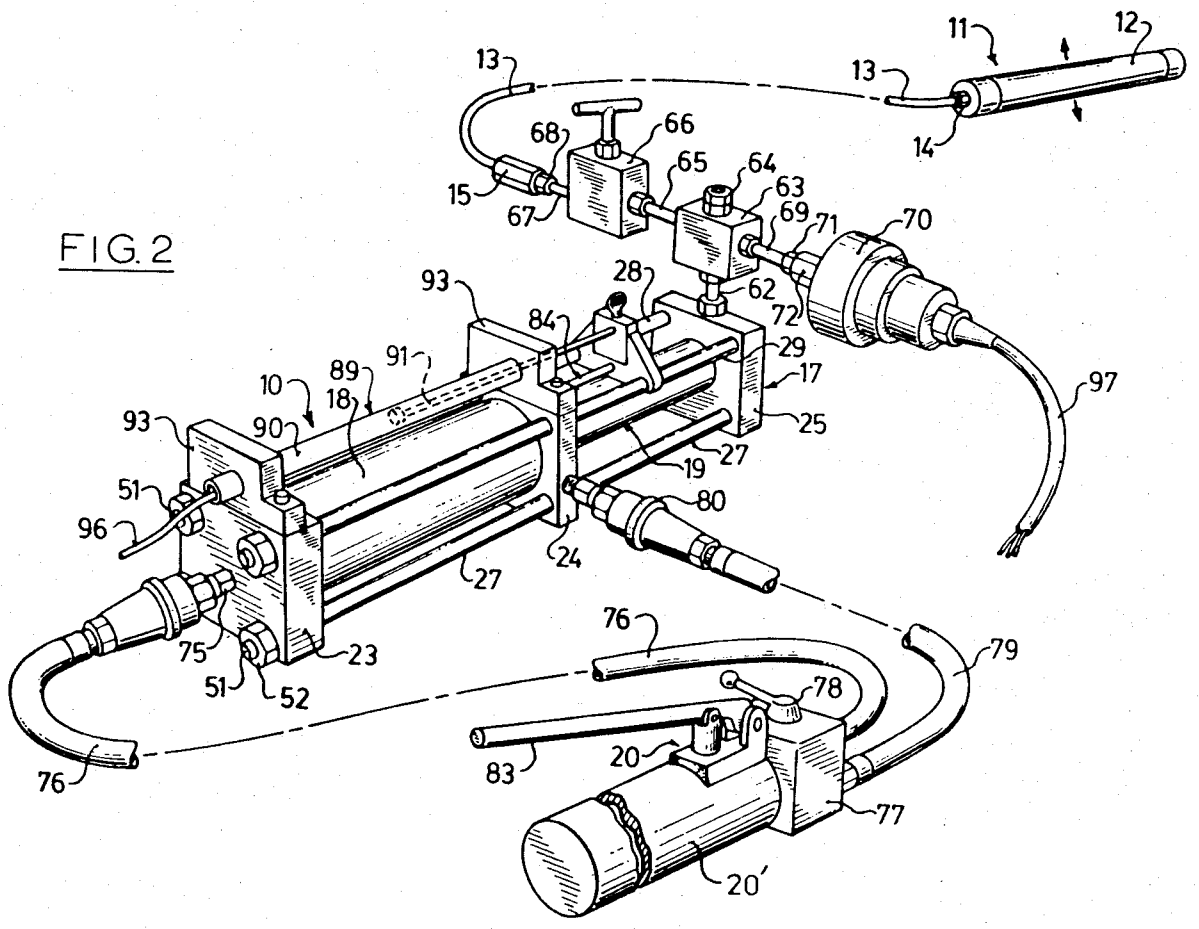
FIG. 2 is a perspective view of a pressure intensifier according to the invention showing also the dilatometer head and the hand operated pump referenced in FIG. 1.
Figure 3:
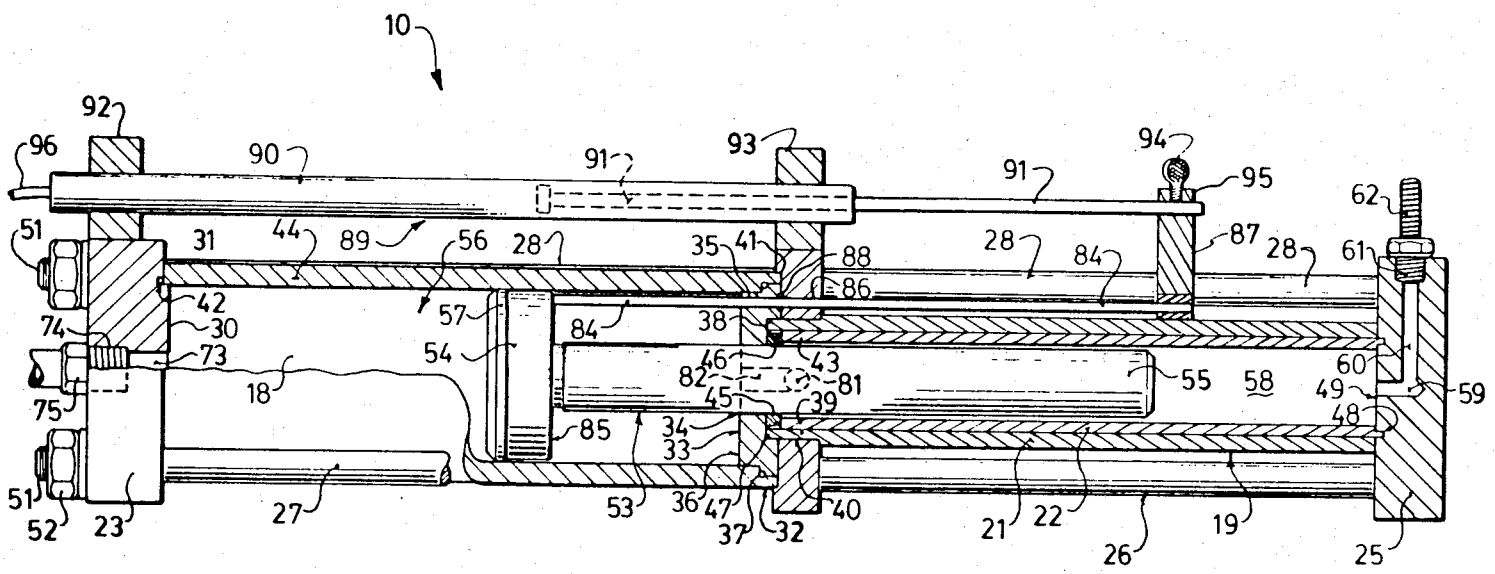
FIG. 3 is a longitudinal sectional view of the pressure intensifier of FIG. 2.

Referring now to FIGS. 2 and 3, there is shown a pressure intensifier 10, for use with a borehole dilatometer head 11 having an expandable body portion 12 defining an internal cavity (not shown). The dilatometer head 11 is of a known type developed by Hustrulid and Hustrulid and known generally as the "Colorado School of Mines cell" (see Hustrulid, A. and Hustrulid, W. "Development of a Borehole Device to Determine the Modulus of Rigidity of Coal Measure Rocks", Final Contract Report H0101705, U.S. Bureau of Mines, Library's open file report, 1972 and Hustrulid, W. and Hustrulid, A., "The CSM Cell—A Borehole Device for Determining the Modulus of Rigidity of Rock", supra). The expandable body portion 12, which defines the internal cavity, comprises an adiprene membrane capable of withstanding pressures in excess of 70 MPa. Lead beads or other fillers (not shown) may be placed in the internal cavity defined by the membrane to reduce water volume and thereby increase the system stiffness. Connecting means, which includes high-pressure, thick-walled tubing 13 is used to connect the internal cavity of the dilatometer head 11 with the pressure intensifier 10 by means of standard high-pressure couplings 14, 15, so as to establish fluid communication between a second cylinder 19 of the intensifier 10 and the internal cavity as described below.

The intensifier 10 itself comprises a housing 17, having positioned therein first and second axially aligned interconnecting cylinders 18, 19, the first cylinder 18 being of larger diameter than the second cylinder 19. In the illustrated embodiment, the diameter of the first cylinder 18 is six times the diameter of the second cylinder 19, with the overall internal length of both cylinders being substantially equal, so that the volume ratio of the cylinders is 6:1.

The first cylinder 18 is preferably constructed from a single length of high strength stainless steel tubing 44, of sufficient strength to withstand normal pressure loading from a hand pump 20, corresponding to Option A in FIG. 1, or from an electrically operated hydraulic pump, corresponding to Option B or C in FIG. 1. The second cylinder 19 is prestressed by having an outer cylindrical sleeve 21 of high strength stainless steel heated and shrunk over an inner cylindrical sleeve 22 of the same material by cooling. This prestressing not only keeps the intensifier very portable, but improves the stiffness of the system by resisting relatively large internal working liquid pressures, the importance of which stiffness has already been emphasized.

The housing further comprises three mounting blocks 23, 24, and 25 and four parallel tie rods 26, 27, 28, and 29.

A raised annular face 30 of the mounting block 23 defines the forward extremity of the first cylinder 18, which face 30 mates with the inside diameter of a forward end 31 of the tubing 44. An annular seal member 42 seals against leakage of pressurized working liquid from between the mounting block 23 and the forward end 31.

The mounting block 24 is centrally located to form a bridge between the first and second aligned cylinders 18, 19. A centrally disposed annular depression 41 on the forward side of the mounting block 24 frictionally accommodates the outside diameter of the rear end 32 of the tubing 44 of the first cylinder 18. The rearward extremity of the first cylinder 18 is defined by a raised annular face 36 of a mounting plate 33 which has a centrally positioned circular aperture 34 and an eccentrically positioned circular aperture 35 of substantially smaller diameter than the aperture 34. The annular face 36 mates with the rear end 32 of the tubing 44 and an annular seal 37 prevents leakage of pressurized working liquid from between the mounting plate 33 and the rear end 32. The mounting plate 33 further features an annular depression 38 on its rearward side centered about the aperture 34, the inside diameter of which depression 38 is dimensioned to engage frictionally the outside diameter of a narrowed forward end portion 39 of the outer sleeve 21 of the second cylinder 19, which end portion 39 first passes through aperture 40 of corresponding size in the mounting block 24. An annular seal member 47 prevents leakage of working fluid under pressure from between the forward end portion 39 of the outer sleeve 21 and the mounting plate 33. A forward end portion 43 of the inner sleeve 22 stops sufficiently short of the forward end portion 39 of the outer sleeve 21 to accommodate the positioning within the inside diameter of the outer sleeve 21 of an annular bushing member 45, the forward face of which abuts agaihst the depression 38 in the mounting plate 33. The bushing member 45 is constructed either of tetrafluoroethylene material or of molybdenum impregnated polyurethane and carries an annular seal member 46 positioned so as to prevent leakage of working fluid under pressure from between the end portion 43 and the bushing member 45.

An annular groove 48 is positioned in the forward face 49 of the mounting block 25 to accept a circumferential lip of the inner sleeve 22 of the second cylinder 19. The overlying outer sleeve 21 abuts against the face 49.

The mounting block 25 further includes an axial connecting channel 59 which opens at its forward end into the second cylinder 19 and which connects at its rearward end into a radial connecting channel 60. The radial connecting channel 60 has a threaded outer end 61 adapted for connection to a first externally threaded connecting tube 62, which tube is itself screw threaded into a junction block 63. The junction block 63 has drilled through its body two mutually perpendicular bores (not shown) which intersect at the block's approximate mid-point to define a cruciform channelway. The four ends of the cruciform channelway are each threaded. The connecting tube 62 engages one threaded end of the cruciform channelway, and a threaded plug 64 engages the opposite end. The plug 64 and the channelway provide a means for introducing a second substantially non-compressible working liquid into the second cylinder 19, and also a means for draining the second working liquid from the second cylinder 19.

A second connecting tube 65 is threaded at its proximal end into an adjacent arm of the cruciform channelway and is threaded at its distal end into a one-way valve member 66 which controls the flow of the second working liquid from the second cylinder 19. A third connecting tube 67 extends from the valve member 66 to a female coupling 68, which coupling engages the correspondingly threaded male coupling 15 of the thick-walled tubing 13.

A fourth connecting tube 69 screw threadingly engages by its proximal end the end of the cruciform channelway opposite the connection of the second connecting tube 65 and, at its distal end, screw threadingly engages, through couplings 71 and 72, a second transducer means 70 for measuring the pressurization of the second working liquid and for providing an electrical signal indicative thereof, which signal is fed by electrical wires 97 to an analog/digital converter as previously discussed. The VIATRAN TM Model No. 218 pressure transducer is one example of a suitable pressure transducer for this application.

The forward threaded ends 51 of the tie rods 26, 27, 28, and 29 pass through respective apertures (not shown) adjacent to each of the four corners of the mounting block 23, where the ends 51 each engage a correspondingly threaded nut 52. The tie rods 26, 27, 28 and 29 extend rearwardly from the first mounting block 23 through a set of four apertures (not shown) positioned adjacent to the four corners of the mounting block 24 and thence onwardly to the mounting block 25, to which they are rigidly affixed by means of threaded ends (not shown) engaging correspondingly threaded sockets (not shown).

A piston 53, having a head portion 54 and a rearwardly directed plunger portion 55 is mounted for reciprocation of the head portion 54 within the first cylinder 18 so as to define a first chamber 56 of variable volume ahead of the head portion 54. A piston ring 57 is preferably mounted on the head portion 54 to aid in the prevention of leakage of working liquid under pressure from the first chamber 56. The plunger portion 55 is mounted, through the bushing 45, for simultaneous linear reciprocation with the head portion 54 within the second cylinder 19 so as to define, together with the connecting means 59, 60, 61, 62, 63, 65, 66, 67, 68, 69, 71, 72, 13, 14, 15, and the internal cavity (not shown) of the dilatometer head 11, a second chamber, generally designated by the reference numeral 58, of variable volume rearwardly of the plunger portion 55. It will be appreciated from the arrangement shown that the second transducer means 70 is mounted on the connecting means in fluid communication with the second chamber so as to measure the pressurization of the second working liquid within the second chamber.

Means for introducing a first substantially non-compressible working liquid into the first chamber 56 are provided in the form of an axial inlet channel 73, which channel passes through the mounting block 23 into the first cylinder 18 and has a threaded end 74 adapted to receive a corresponding threads coupling 75 positioned on the end of a first hydraulic hose 76. The hydraulic hose 76 is connected at its opposite end to a two-way cylinder valve 77 controlled by a handle 78, which valve 77 is in turn connected to the hand operated hydraulic pump 20.

A second hydraulic hose 79 connects the pump 20 by means of a threaded coupling 80 to a radial bore 81 in the mounting plate 24, which bore 81 connects to an axial bore 82, which axial bore passes through the mounting plate 33 to communicate with the interior of the first cylinder 18 rearwardly of the piston head 56.

A first transducer means for measuring the linear displacement of the piston 53 and for providing an electrical signal indicative thereof is provided in the form of a linear variance differential transformer (LVDT), designated by the general reference numeral 89, having a body portion 90 and a core-rod portion 91. The cylindrical body portion 90 is rigidly affixed to the housing 17 by means of mounting brackets 92, 93, which brackets are bolted or otherwise affixed to the mounting blocks 23, 24, respectively. The core-rod portion 91 is rigidly attached to the head portion 54 of the piston 53 by means of the interconnecting slide member 87 and the push rod 84. A turnscrew 94 releasably grips the core-rod 91 in a socket 95 in the slide member 87, allowing for calibration of the LVDT 89. One suitable LVDT for this application is the SCHAEVITZ TM Type 2000 HR AC LVDT. Electrical conductors 96 carry the analog signal output from the LVDT to an analog/digital converter as previously discussed.

Prior to operation, the first cylinder 18 is filled through the inlet channel 73 with a first substantially non-compressible working liquid such as a high-viscous hydraulic oil, the operator being careful to exclude as much air as is possible. The two-way cylinder valve 77 is set so as to supply, working liquid under pressure from a storage tank 201 of the pump 20 to the first hydraulic hose 76, and the pump 20 and hose 76 are then bled to remove any air therefrom. Once this is accomplished, the coupling 75 is then connected to the inlet channel 73 to supply the first working liquid under pressure to the first chamber 56 upon pumping of the pump handle 83. Pressurization of the first working liquid within the first chamber 56 linearly displaces the head portion 54 of the piston 53 in the rearward direction from an initial forward position, causing the plunger portion 55 simultaneously to reciprocate rearwardly within the second cylinder 19. A push rod 84 is rigidly attached to the rear face 85 of the pistion head 54, indicating the linear position of the piston 53. The push rod 84 extends rearwardly from the rear face 85, through the aperture 35 in the mounting plate 33, through an aligned aperture 86 in the mounting block 24, and thence rearwardly to be rigidly gripped by a slide member 87, which slide member is adapted to slide longitudinally along the tie rods 28 and 29 in response to urging by the push rod 84. An annular seal 88 surrounds the aperture 86 to prevent leakage of working liquid under pressure from the aperture 86.

After filling the first cylinder 18, the handle is pumped with the plug 64 removed, until the piston plunger 55 travels rearwardly to its fullest extent, so as to exhaust the air from the second cylinder 19. The two-way cylinder valve 77 is then reversed by using the handle 78, so that the first working liquid now flows under pressure through the second hydraulic hose 79 into the first cylinder 18 rearwardly of the piston head 54. In this manner, further pumping of the handle 83 causes the piston head portion 53 to return to its initial forward position, the first working liquid now being removed from the first chamber 56 through the first hydraulic hose 76.

A second substantially non-compressible working liquid, preferably of lower viscosity than the first working liquid, for example water, so as to provide for a faster response time in the second chamber 58, is introduced into the second chamber by means of the opening for the plug 64. If the second working liquid is so introduced just prior to retraction of the piston 53 to its starting position, introduction of air into the second cylinder 19 can be substantially avoided. The remainder of the second chamber 58 is then filled with water and all air is bled from the system before taking the first measurements.

In operation, an Ex-sized borehole (3.8 cm) is drilled to a maximum depth of about 20 meters. The dilatometer head 11 is lowered into the borehole with the aid of placement rods (not shown). The pump handle 83 is then stroked to pressurize the first working liquid within the first chamber 56, which pressurization causes movement of the head 54 and plunger 55 portions of the piston 53, resulting in substantially higher pressurization of the second working liquid in the second chamber 58. which higher pressurization causes deformation of the extensible body portion 12 of the dilatometer head 11. The pressure transducer 70 measures the degree of pressurization of the second chamber 58 while the LVDT 89 measures changes in the displacement of the piston head 53, which changes represent volume changes of the second chamber 58 and are correlated thereto by simple calibration.

We claim:

1. A pressure intensifier for use with a borehole dilatometer head having an expandable body portion defining an internal cavity, the intensifier comprising, in combination:

a housing having positioned therein first and second axially aligned interconnecting cylinders, said first cylinder being of larger diameter than said second cylinder;

connecting means for establishing fluid communication between said second cylinder and said internal cavity;

a piston having a head portion and a rearwardly directed plunger portion, the piston being mounted for linear reciprocation of the head portion within the first cylinder so as to define a first chamber of variable volume ahead of the head portion, the plunger portion being mounted for simultaneous linear reciprocation within the second cylinder so as to define, together with said internal cavity and said connecting means, a second chamber of variable volume rearwardly of said plunger portion;

means for introducing a first substantially non-compressible working liquid into said first chamber;

means for introducing a second substantially non-compressible working liquid into said second chamber;

means for pressurizing the first working liquid within the first chamber so as to displace the head portion linearly in the rearward direction from an initial forward position, thereby pressurizing the second working liquid within the second chamber;

first transducer means for measuring the linear displacement of the piston and for providing an electrical signal indicative thereof, and second transducer means for measuring pressure changes of the second working liquid and for providing an electrical signal indicative thereof, said first and second transducer means each providing an analog electrical signal; and means for returning the head portion to said initial forward position, said returning means including means for substantially removing the first working liquid from the first chamber;

wherein the first transducer means is a linear variable differential transformer having a body and a core-rod portion, the body being affixed to the housing and the core-rod portion being rigidly attached to the head portion.

2. An intensifier according to claim 1, wherein the second transducer means is mounted on the connecting means in fluid communication with the second chamber so as to measure the pressure changes of the second working liquid.

3. An intensifer according to claim 2, further comprising electrical communication means interconnecting the first and second transducer means with a digital computer via analog/digital converter means and providing separate communication channels for each analog signal.

4. An intensifier according to claim 2, wherein the means for pressurizing the first working liquid is an electric hydraulic pump.

5. An intensifier according to claim 4, wherein the electric hydraulic pump is fitted.with a servo-control unit.

6. An intensifier according to claim 2, wherein the means for pressurizing the first working liquid is a hand pump.

* * * * *